US012654078B2

(12) United States Patent
Davis et al.

(10) Patent No.: US 12,654,078 B2
(45) **Date of Patent: *Jun. 16, 2026**

(54) SPORTING GOODS INCLUDING MICROLATTICE STRUCTURES

(71) Applicant: Bauer Hockey, LLC, Exeter, NH (US)

(72) Inventors: Stephen J. Davis, Van Nuys, CA (US); Dewey Chauvin, Simi Valley, CA (US)

(73) Assignee: BAUER HOCKEY LLC, Exeter, NH (US)

( * ) Notice: Subject to any disclaimer, the term of this patent is extended or adjusted under 35 U.S.C. 154(b) by 0 days.

This patent is subject to a terminal disclaimer.

(21) Appl. No.: 18/386,924

(22) Filed: Nov. 3, 2023

(65) Prior Publication Data

US 2024/0123305 A1 Apr. 18, 2024

Related U.S. Application Data

(63) Continuation of application No. 15/922,526, filed on Mar. 15, 2018, now Pat. No. 11,844,986, which is a (Continued)

(51) Int. Cl.

*A63B 59/51* (2015.01)
*A42B 3/00* (2006.01)

(Continued)

(52) U.S. Cl.

CPC ..... *A63B 59/51* (2015.10); *A43B 1/00* (2013.01); *A63B 59/54* (2015.10); *A63B 59/70* (2015.10); *A63B 60/08* (2015.10); *A63B 60/54* (2015.10); *A63B 71/10* (2013.01); *A42B 3/00* (2013.01); *A43B 5/16* (2013.01); *A63B 2102/18* (2015.10); *A63B 2102/22* (2015.10);

(Continued)

(58) Field of Classification Search

CPC ..... A63B 59/51; A63B 59/54; A63B 59/70; A63B 60/08; A63B 60/54; A63B 71/10; A63B 2102/18; A63B 2102/22; A63B 2102/24; A63B 2209/00; A63B 2209/02; A43B 1/00; A43B 5/16; A42B 3/00

See application file for complete search history.

(56) References Cited

U.S. PATENT DOCUMENTS 3,276,784 A 10/1966 Anderson, Jr.
4,042,238 A 8/1977 Theriault (Continued)

FOREIGN PATENT DOCUMENTS

CA 2294301 A1 1/2000
CA 2145520 C 3/2006

(Continued)

OTHER PUBLICATIONS

Non-Final Office Action issued on Nov. 18, 2024 in connection with U.S. Appl. No. 18/196,023, 11 pages.

(Continued)

*Primary Examiner* — Jeffrey S Vanderveen

(74) *Attorney, Agent, or Firm* — Banner & Witcoff, Ltd.

(57) ABSTRACT

A sport helmet may include a first surface and a second surface opposite one another, and a lattice formed of flexible polymeric material, configured to deform from an initial shape upon an impact on the sport helmet and recover the initial shape thereafter to absorb at least part of the impact.

39 Claims, 3 Drawing Sheets

Related U.S. Application Data continuation of application No. 14/276,739, filed on May 13, 2014, now Pat. No. 9,925,440.

(51) Int. Cl.

| | |
|---|---|
| ***A43B 1/00*** | (2006.01) |
| ***A43B 5/16*** | (2006.01) |
| ***A63B 59/54*** | (2015.01) |
| ***A63B 59/70*** | (2015.01) |
| ***A63B 60/08*** | (2015.01) |
| ***A63B 60/54*** | (2015.01) |
| ***A63B 71/10*** | (2006.01) |
| ***A63B 102/18*** | (2015.01) |
| ***A63B 102/22*** | (2015.01) |
| ***A63B 102/24*** | (2015.01) |

(52) U.S. Cl.

CPC ..... *A63B 2102/24* (2015.10); *A63B 2209/00* (2013.01); *A63B 2209/02* (2013.01)

(56) References Cited

U.S. PATENT DOCUMENTS 4,124,208 A 11/1978 Burns
4,134,155 A 1/1979 Robertson
4,324,400 A 4/1982 Tse
5,217,221 A 6/1993 Baum
5,333,857 A 8/1994 Lallemand
5,524,641 A 6/1996 Battaglia
5,544,367 A 8/1996 March, II
5,593,158 A * 1/1997 Filice ..... A63B 60/08 473/566
5,613,916 A 3/1997 Sommer
5,661,854 A 9/1997 March, II
5,865,696 A * 2/1999 Calapp ..... A63B 59/70 473/561
5,946,734 A 9/1999 Vogan
6,015,156 A * 1/2000 Pratt ..... A43B 5/1641 280/11.224
6,033,328 A * 3/2000 Bellefleur ..... A63B 60/08 473/561
6,079,056 A 6/2000 Fogelberg
6,129,962 A 10/2000 Quigley et al.
6,247,181 B1 6/2001 Hirsch et al.
6,763,611 B1 7/2004 Fusco
6,775,928 B2 8/2004 Grande et al.
6,805,642 B2 10/2004 Meyer
6,918,847 B2 * 7/2005 Gans ..... A63B 59/70 473/563
7,008,338 B2 3/2006 Pearson
7,097,577 B2 8/2006 Goldsmith et al.
7,120,941 B2 10/2006 Glaser
7,178,428 B2 2/2007 Schroder
7,207,907 B2 4/2007 Guenther et al.
7,219,900 B2 5/2007 Meibock
7,244,196 B2 7/2007 Kennedy et al.
7,382,959 B1 6/2008 Jacobsen
7,387,578 B2 6/2008 Palumbo et al.
7,424,967 B2 9/2008 Ervin et al.
7,476,167 B2 1/2009 Garcia
7,510,206 B2 3/2009 Walker
7,614,969 B2 11/2009 Meyer et al.
7,625,625 B2 12/2009 Rios et al.
7,627,938 B2 12/2009 Kim et al.
7,786,243 B2 8/2010 Wu et al.
7,824,591 B2 11/2010 Gans
7,906,191 B2 3/2011 Pratt
7,931,549 B2 4/2011 Pearson et al.
7,941,875 B1 5/2011 Doctor et al.
7,963,868 B2 6/2011 McGrath et al.
7,994,269 B2 8/2011 Ricci et al.
8,007,373 B2 8/2011 Soracco et al.
8,052,551 B2 11/2011 Blotteaux et al.
8,088,461 B2 1/2012 Fujihana et al.
8,287,403 B2 10/2012 Chao et al.
8,323,130 B1 12/2012 LeVault et al.
8,387,286 B2 3/2013 Koyess et al.
8,449,411 B2 5/2013 LeVault et al.
8,505,222 B2 8/2013 Koyess
8,602,923 B2 12/2013 Jeanneau
8,608,597 B2 12/2013 Avnery et al.
8,623,490 B2 1/2014 Lin et al.
8,663,027 B2 3/2014 Morales et al.
8,801,550 B2 8/2014 Jeanneau et al.
8,921,702 B1 12/2014 Carter et al.
8,998,754 B2 4/2015 Shocklee et al.
9,044,657 B2 6/2015 Jeanneau
9,056,229 B2 6/2015 Hungerbach et al.
9,086,229 B1 * 7/2015 Roper ..... G02B 5/0825
9,116,428 B1 * 8/2015 Jacobsen ..... B32B 3/12
9,119,433 B2 9/2015 Leon
9,199,139 B2 12/2015 Kronenberg et al.
9,201,988 B2 12/2015 Stanhope et al.
9,283,895 B2 3/2016 Sumi et al.
9,320,316 B2 4/2016 Guyan et al.
9,320,317 B2 4/2016 Bernhard et al.
9,375,041 B2 6/2016 Plant
9,409,065 B2 8/2016 Morales et al.
9,415,269 B2 8/2016 Tomita et al.
9,452,323 B2 9/2016 Kronenberg et al.
9,468,823 B2 10/2016 Mitton et al.
9,486,679 B2 11/2016 Goldstein et al.
9,498,014 B2 11/2016 Princip et al.
9,539,487 B2 1/2017 Henry
9,566,758 B2 * 2/2017 Cheung ..... E04B 1/02
9,573,024 B2 2/2017 Bender
9,586,112 B2 3/2017 Sola et al.
9,594,368 B2 3/2017 Kronenberg et al.
9,668,531 B2 6/2017 Nordstrom et al.
9,694,540 B2 7/2017 Trockel
9,737,747 B1 8/2017 Walsh et al.
9,756,894 B2 9/2017 McDowell et al.
9,756,899 B2 9/2017 Waatti
9,788,594 B2 10/2017 Jarvis
9,788,603 B2 10/2017 Jarvis
9,795,181 B2 10/2017 Jarvis
9,839,251 B2 12/2017 Pannikottu et al.
9,841,075 B2 12/2017 Russo
9,878,217 B2 1/2018 Morales et al.
9,889,347 B2 2/2018 Morales et al.
9,892,214 B2 2/2018 Morrow et al.
9,914,274 B2 3/2018 Jones
9,925,440 B2 3/2018 Davis et al.
10,010,133 B2 7/2018 Guyan
10,010,134 B2 7/2018 Guyan
10,016,013 B2 7/2018 Kormann et al.
10,034,519 B2 7/2018 Lussier
10,039,343 B2 8/2018 Guyan
10,052,223 B2 8/2018 Turner
10,085,508 B2 10/2018 Surabhi
10,104,934 B2 10/2018 Guyan
10,143,252 B2 12/2018 Nordstrom et al.
10,143,266 B2 12/2018 Spanks
10,155,855 B2 12/2018 Farris et al.
10,212,983 B2 2/2019 Knight
10,226,098 B2 3/2019 Guyan et al.
10,226,103 B2 3/2019 Mark
10,231,510 B2 3/2019 Wawrousek et al.
10,231,511 B2 3/2019 Guyan et al.
10,241,498 B1 3/2019 Beard
10,244,818 B2 4/2019 DesJardins et al.
10,258,093 B2 4/2019 Smart
10,259,041 B2 4/2019 Gessler et al.
10,259,236 B2 4/2019 Miller
10,264,851 B2 4/2019 Waatti
10,279,235 B2 5/2019 Jean et al.
10,279,581 B2 5/2019 Ashcroft et al.
10,293,565 B1 5/2019 Tran et al.
10,299,722 B1 5/2019 Tran et al.
10,322,320 B2 6/2019 Morales et al.
10,327,700 B2 6/2019 Lee et al.
10,335,646 B2 7/2019 Morales et al.
10,343,031 B1 7/2019 Day et al.

(56) References Cited

U.S. PATENT DOCUMENTS 10,362,829 B2 7/2019 Lowe
10,384,106 B2 8/2019 Hunt et al.
10,390,578 B2 8/2019 Kuo et al.
10,394,050 B2 8/2019 Rasschaert et al.
10,398,948 B2 9/2019 Cardani et al.
10,413,804 B2 9/2019 Lefebvre et al.
10,426,213 B2 10/2019 Hyman
10,452,053 B2 10/2019 Lalish et al.
10,455,896 B2 10/2019 Sterman et al.
10,463,525 B2 11/2019 Littlefield et al.
10,470,519 B2 11/2019 Guyan et al.
10,470,520 B2 11/2019 Guyan et al.
10,517,381 B2 12/2019 Frash
10,525,315 B1 1/2020 Wells et al.
10,575,586 B2 3/2020 Guyan et al.
10,575,587 B2 3/2020 Guyan
10,575,588 B2 3/2020 Perrault et al.
10,591,257 B1 3/2020 Barr et al.
10,624,413 B2 4/2020 Kirk et al.
10,631,592 B2 4/2020 Lee-Sang
10,632,010 B2 4/2020 Hart et al.
10,638,805 B2 5/2020 Fella
10,638,810 B1 5/2020 Cheney et al.
10,638,927 B1 5/2020 Beard et al.
10,646,356 B2 5/2020 Deshpande et al.
10,668,334 B2 6/2020 Madson et al.
10,695,642 B1 6/2020 Robinson
10,696,066 B2 6/2020 Miller
10,702,012 B2 7/2020 Guyan
10,702,740 B2 7/2020 Tarkington et al.
10,721,990 B2 7/2020 Campos et al.
10,737,147 B2 8/2020 Morales et al.
10,743,610 B2 8/2020 Guyan et al.
10,750,820 B2 8/2020 Guyan
10,751,590 B1 8/2020 Wells et al.
10,779,614 B2 9/2020 Re et al.
10,791,787 B2 10/2020 Hector, Jr. et al.
10,792,541 B2 10/2020 Cardani et al.
10,829,640 B2 11/2020 Beyer et al.
10,835,786 B2 11/2020 Morales et al.
10,842,210 B2 11/2020 Nordstrom et al.
10,850,165 B2 12/2020 Nürnberg et al.
10,850,169 B1 12/2020 Day et al.
10,864,105 B2 12/2020 Dillingham
10,864,676 B2 12/2020 Constantinou et al.
10,875,239 B2 12/2020 McCluskey
10,881,167 B2 1/2021 Jeng et al.
10,888,754 B2 1/2021 Wells et al.
10,890,970 B2 1/2021 Emokpae
10,893,720 B2 1/2021 Van Atta
10,899,868 B2 1/2021 Rolland et al.
10,918,157 B2 2/2021 Choukeir
10,932,500 B2 3/2021 Thomas et al.
10,932,515 B2 3/2021 Busbee
10,932,521 B2 3/2021 Perrault et al.
10,933,609 B2 3/2021 Gupta et al.
10,945,488 B2 3/2021 Davis et al.
10,946,583 B2 3/2021 Constantinou et al.
10,948,898 B1 3/2021 Pietrzak et al.
10,974,447 B2 4/2021 Constantinou et al.
11,026,482 B1 6/2021 Unis
11,033,796 B2 6/2021 Bologna et al.
11,052,597 B2 7/2021 MacCurdy et al.
D927,084 S 8/2021 Bologna et al.
11,076,656 B2 8/2021 Kormann et al.
11,090,863 B2 8/2021 Constantinou et al.
11,111,359 B2 9/2021 Kunc et al.
11,155,052 B2 10/2021 Jessiman et al.
11,167,198 B2 11/2021 Bologna et al.
11,167,395 B2 11/2021 Merlo et al.
11,167,475 B2 11/2021 Donovan
11,172,719 B2 11/2021 Briggs
11,178,938 B2 11/2021 Kulenko et al.
11,185,123 B2 11/2021 Waatti et al.
11,185,125 B2 11/2021 Blanche et al.
11,191,319 B2 12/2021 Weisskopf et al.
11,206,895 B2 12/2021 Hopkins et al.
11,219,270 B2 1/2022 Oleson et al.
11,224,265 B2 1/2022 Jarvis
11,229,259 B2 1/2022 Farris et al.
11,547,912 B2 1/2023 Davis et al.
11,684,104 B2 6/2023 Laperriere et al.
11,779,821 B2 10/2023 Davis et al.
11,794,084 B2 10/2023 Davis et al.
11,844,986 B2 12/2023 Davis et al.
12,369,668 B2 7/2025 Laperrière et al.
2004/0102115 A1 5/2004 Chou
2005/0027025 A1 2/2005 Erb et al.
2005/0245090 A1 11/2005 Mori et al.
2005/0251898 A1 11/2005 Domingos
2006/0179686 A1 8/2006 Labontéet al.
2007/0000025 A1 1/2007 Picotte
2007/0204378 A1 9/2007 Behar
2007/0270253 A1 11/2007 Davis et al.
2007/0277296 A1 12/2007 Bullock
2008/0172906 A1 7/2008 Jou et al.
2009/0191989 A1 7/2009 Lammer et al.
2009/0264230 A1 10/2009 Thouin
2010/0156058 A1 6/2010 Koyess et al.
2010/0160095 A1 6/2010 Chauvin et al.
2010/0251465 A1 10/2010 Milea et al.
2010/0263231 A1 10/2010 Smirman
2011/0111954 A1 5/2011 Li et al.
2012/0297526 A1* 11/2012 Leon ..... A63B 71/10 2/413
2013/0025031 A1 1/2013 Laperriere et al.
2013/0025032 A1 1/2013 Durocher et al.
2013/0143060 A1 6/2013 Jacobsen et al.
2013/0196175 A1 8/2013 Levit et al.
2013/0232674 A1 9/2013 Behrend et al.
2013/0269215 A1 10/2013 Smirman
2014/0013492 A1 1/2014 Bottlang et al.
2014/0013862 A1 1/2014 Lind
2014/0075652 A1 3/2014 Hanson et al.
2014/0090155 A1 4/2014 Johnston et al.
2014/0109440 A1 4/2014 McDowell et al.
2014/0163445 A1 6/2014 Pallari et al.
2014/0182170 A1 7/2014 Wawrousek et al.
2014/0259327 A1 9/2014 Demarest
2014/0272275 A1 9/2014 Yang et al.
2014/0311315 A1 10/2014 Isaac
2014/0323250 A1 10/2014 Jeanneau
2015/0018136 A1 1/2015 Goldstein et al.
2015/0121609 A1 5/2015 Cote
2015/0246496 A1 9/2015 Jones et al.
2015/0272258 A1 10/2015 Preisler
2015/0298443 A1 10/2015 Hundley et al.
2015/0307044 A1* 10/2015 Hundley ..... B29C 39/38 293/120
2015/0313305 A1 11/2015 Daetwyler et al.
2015/0328512 A1 11/2015 Davis et al.
2016/0135537 A1 5/2016 Wawrousek et al.
2016/0192741 A1 7/2016 Mark
2016/0206048 A1 7/2016 Weidl et al.
2016/0235158 A1 8/2016 DesJardins et al.
2016/0235560 A1 8/2016 Cespedes et al.
2016/0302494 A1 10/2016 Smart
2016/0302496 A1 10/2016 Ferrara
2016/0327113 A1 11/2016 Shelley
2016/0332036 A1 11/2016 Molinari et al.
2016/0333152 A1 11/2016 Cook et al.
2016/0349738 A1 12/2016 Sisk
2016/0353825 A1 12/2016 Bottlang et al.
2016/0374428 A1 12/2016 Kormann et al.
2016/0374431 A1 12/2016 Tow
2017/0021246 A1 1/2017 Goldstein et al.
2017/0105475 A1 4/2017 Huang
2017/0106622 A1 4/2017 Bonin
2017/0164899 A1 6/2017 Yang et al.
2017/0185070 A1 6/2017 Kronenberg et al.
2017/0239933 A1 8/2017 Schiettecatte et al.
2017/0251747 A1 9/2017 Pippin
2017/0273386 A1 9/2017 Kuo et al.
2017/0282030 A1 10/2017 Foortse

(56) References Cited

U.S. PATENT DOCUMENTS

2017/0303622 A1 10/2017 Stone et al.
2017/0318900 A1 11/2017 Charlesworth et al.
2017/0332733 A1 11/2017 Cluckers et al.
2017/0350555 A1 12/2017 Jertson et al.
2017/0360148 A1 12/2017 Hayes et al.
2018/0007996 A1 1/2018 Sedwick et al.
2018/0027914 A1 2/2018 Cook
2018/0027916 A1 2/2018 Smallwood
2018/0028336 A1 2/2018 Pallari et al.
2018/0036944 A1 2/2018 Jarvis
2018/0085647 A1 3/2018 Caron Kardos et al.
2018/0098589 A1 4/2018 Diamond
2018/0098919 A1 4/2018 Pallari et al.
2018/0103704 A1 4/2018 Smart
2018/0104922 A1 4/2018 Busgen et al.
2018/0116329 A1 5/2018 Champagne et al.
2018/0132556 A1 5/2018 Laperriere et al.
2018/0140898 A1 5/2018 Kasha
2018/0184732 A1 7/2018 Plant
2018/0200591 A1 7/2018 Davis et al.
2018/0231347 A1 8/2018 Tyler et al.
2018/0237600 A1 8/2018 Cox et al.
2018/0253774 A1 9/2018 Soracco et al.
2018/0290044 A1 10/2018 Jin et al.
2018/0339445 A1 11/2018 Loveder
2018/0339478 A1 11/2018 Lee
2018/0341286 A1 11/2018 Markovsky et al.
2018/0345575 A1 12/2018 Constantinou et al.
2018/0361217 A1 12/2018 Yanoff et al.
2019/0029367 A1 1/2019 Yangas
2019/0029369 A1 1/2019 VanWagnen et al.
2019/0037961 A1 2/2019 Busbee et al.
2019/0039311 A1 2/2019 Busbee et al.
2019/0045857 A1 2/2019 Fan et al.
2019/0045879 A1 2/2019 Labonte et al.
2019/0075876 A1 3/2019 Burek
2019/0082785 A1 3/2019 Spanks
2019/0090576 A1 3/2019 Guinta
2019/0098960 A1 4/2019 Weisskopf et al.
2019/0104792 A1 4/2019 Diamond
2019/0133235 A1 5/2019 Domanskis et al.
2019/0150549 A1 5/2019 Von Dunten et al.
2019/0167463 A1 6/2019 Littlefield et al.
2019/0184629 A1 6/2019 Kerrigan
2019/0191794 A1 6/2019 Boria
2019/0200703 A1 7/2019 Mark
2019/0223797 A1 7/2019 Tran et al.
2019/0231018 A1 8/2019 Boutin
2019/0232591 A1 8/2019 Sterman et al.
2019/0232592 A1 8/2019 Tran et al.
2019/0240896 A1 8/2019 Achten et al.
2019/0246741 A1 8/2019 Busbee et al.
2019/0248067 A1 8/2019 Achten et al.
2019/0248089 A1 8/2019 Busbee et al.
2019/0269194 A1 9/2019 Pietrzak et al.
2019/0289934 A1 9/2019 Lee
2019/0290981 A1 9/2019 Davis et al.
2019/0290982 A1 9/2019 Davis et al.
2019/0290983 A1 9/2019 Davis et al.
2019/0313732 A1 10/2019 Russell et al.
2019/0329491 A1 10/2019 Yu et al.
2019/0335838 A1 11/2019 Hoshizaki
2019/0344150 A1 11/2019 Dreve
2019/0358486 A1 11/2019 Higginbotham, III
2019/0365021 A1 12/2019 Okajima
2019/0365045 A1 12/2019 Kiederle et al.
2019/0381389 A1 12/2019 Nysæther
2019/0382089 A1 12/2019 O'Brien
2020/0015543 A1 1/2020 Roser
2020/0022444 A1 1/2020 Stone et al.
2020/0029654 A1 1/2020 Yangas
2020/0034016 A1 1/2020 Boissonneault et al.
2020/0046062 A1 2/2020 Perillo et al.
2020/0046075 A1 2/2020 Sterman et al.
2020/0060377 A1 2/2020 Dua et al.
2020/0061412 A1 2/2020 Crosswell
2020/0085606 A1 3/2020 Turner
2020/0094473 A1 3/2020 Constantinou et al.
2020/0100554 A1 4/2020 Bologna et al.
2020/0101252 A1 4/2020 Oddo
2020/0113267 A1 4/2020 Light et al.
2020/0114178 A1 4/2020 Waterford et al.
2020/0121991 A1 4/2020 Emadikotak et al.
2020/0128914 A1 4/2020 Bosmans et al.
2020/0154803 A1 5/2020 Goulet et al.
2020/0154818 A1 5/2020 Fu
2020/0154822 A1 5/2020 Kita et al.
2020/0163408 A1 5/2020 Guyan
2020/0164582 A1 5/2020 Siegl et al.
2020/0170341 A1 6/2020 Guyan et al.
2020/0171742 A1 6/2020 Constantinou et al.
2020/0196706 A1 6/2020 Perrault et al.
2020/0206020 A1 7/2020 Hart et al.
2020/0215415 A1 7/2020 Bologna et al.
2020/0215746 A1 7/2020 Miller
2020/0238604 A1 7/2020 Hart et al.
2020/0255618 A1 8/2020 Krick et al.
2020/0255660 A1 8/2020 Durand et al.
2020/0268077 A1 8/2020 Schmidt et al.
2020/0268080 A1 8/2020 Schmidt et al.
2020/0276770 A1 9/2020 Zheng
2020/0281310 A1 9/2020 Guyan
2020/0283683 A1 9/2020 Yakacki
2020/0297051 A1 9/2020 Quadling et al.
2020/0299452 A1 9/2020 Vontorcik, Jr. et al.
2020/0305534 A1 10/2020 Chilson
2020/0305552 A1 10/2020 Cheney et al.
2020/0324464 A1 10/2020 Reese et al.
2020/0329811 A1 10/2020 Davis
2020/0329814 A1 10/2020 Wang et al.
2020/0329815 A1 10/2020 Schmid
2020/0359728 A1 11/2020 Plant
2020/0367607 A1 11/2020 Cheney et al.
2020/0368588 A1 11/2020 Morales et al.
2020/0375270 A1 12/2020 Holschuh et al.
2020/0390169 A1 12/2020 Waterloo
2020/0391085 A1 12/2020 Shassian
2020/0406537 A1 12/2020 Cross et al.
2021/0001157 A1 1/2021 Rashaud et al.
2021/0001560 A1 1/2021 Cook et al.
2021/0016139 A1 1/2021 Cardani et al.
2021/0022429 A1 1/2021 Ostergard
2021/0023775 A1 1/2021 Poelma et al.
2021/0024775 A1 1/2021 Rolland et al.
2021/0030107 A1 2/2021 Pratt et al.
2021/0030113 A1 2/2021 Schuster
2021/0037908 A1 2/2021 Busbee
2021/0038947 A1 2/2021 Nürnberg et al.
2021/0052955 A1 2/2021 DeMille et al.
2021/0068475 A1 3/2021 Coccia et al.
2021/0068495 A1 3/2021 Telatin et al.
2021/0069556 A1 3/2021 Morales et al.
2021/0076771 A1 3/2021 Guyan et al.
2021/0077865 A1 3/2021 Morales et al.
2021/0079970 A1 3/2021 Betteridge et al.
2021/0085012 A1 3/2021 Alvaro
2021/0101331 A1 4/2021 Su
2021/0112906 A1 4/2021 Bologna et al.
2021/0117589 A1 4/2021 Banadyha et al.
2021/0145116 A1 5/2021 Kvamme
2021/0145125 A1 5/2021 Miller et al.
2021/0146227 A1 5/2021 Bhagwat
2021/0169179 A1 6/2021 Louko
2021/0177090 A1 6/2021 Vandecruys et al.
2021/0177093 A1 6/2021 Perrault et al.
2021/0186151 A1 6/2021 Gross
2021/0186152 A1 6/2021 Kumar et al.
2021/0186154 A1 6/2021 Yuasa
2021/0187897 A1 6/2021 Reinhall et al.
2021/0195982 A1 7/2021 Pietrzak et al.
2021/0195989 A1 7/2021 Iwasa et al.
2021/0195995 A1 7/2021 Sakamoto et al.
2021/0206054 A1 7/2021 Constantinou et al.
2021/0246959 A1 8/2021 Kabaria et al.

(56) References Cited

U.S. PATENT DOCUMENTS

| | | | |
|---|---|---|---|
| 2021/0283855 | A1 | 9/2021 | Bologna et al. |
| 2021/0299543 | A1 | 9/2021 | Bologna et al. |
| 2021/0321713 | A1 | 10/2021 | Busbee |
| 2021/0321716 | A1 | 10/2021 | Kormann et al. |
| 2021/0341031 | A1 | 11/2021 | Kabaria et al. |
| 2021/0347112 | A1 | 11/2021 | Su et al. |
| 2021/0347114 | A1 | 11/2021 | Boettcher et al. |
| 2021/0354413 | A1 | 11/2021 | Jones et al. |
| 2021/0358097 | A1 | 11/2021 | Harig |
| 2021/0368910 | A1 | 12/2021 | Moller et al. |
| 2021/0368912 | A1 | 12/2021 | Russell et al. |
| 2021/0370400 | A1 | 12/2021 | Benichou et al. |
| 2021/0401109 | A1 | 12/2021 | Labonte et al. |
| 2022/0000212 | A1 | 1/2022 | Busbee |
| 2022/0000216 | A1 | 1/2022 | Carlucci et al. |
| 2022/0007785 | A1 | 1/2022 | Mitchell et al. |
| 2022/0016861 | A1 | 1/2022 | Carlucci et al. |
| 2022/0022594 | A1 | 1/2022 | Dippel et al. |
| 2022/0079280 | A1 | 3/2022 | Laperriere et al. |
| 2022/0142284 | A1 | 5/2022 | Laperriere et al. |
| 2022/0296975 | A1 | 9/2022 | Krick et al. |
| 2023/0337781 | A1 | 10/2023 | Corbeil et al. |
| 2023/0346065 | A1 | 11/2023 | Laperriere et al. |

FOREIGN PATENT DOCUMENTS

| | | | |
|---|---|---|---|
| CA | 2949062 | A1 | 11/2015 |
| CA | 3054530 | A1 | 11/2015 |
| CA | 3054547 | C | 11/2015 |
| CA | 3140503 | A1 | 11/2020 |
| CA | 3140505 | A1 | 11/2020 |
| CA | 3054525 | C | 2/2022 |
| CA | 3054536 | C | 3/2022 |
| CN | 105218939 | B | 10/2017 |
| EP | 3142753 | B1 | 3/2017 |
| EP | 3253243 | B1 | 4/2020 |
| WO | 2013025800 | A2 | 2/2013 |
| WO | 2013151157 | A1 | 10/2013 |
| WO | 2014100462 | A1 | 6/2014 |
| WO | 2015175541 | A1 | 11/2015 |
| WO | 2016209872 | A1 | 12/2016 |
| WO | 2017062945 | A1 | 4/2017 |
| WO | 2017136890 | A1 | 8/2017 |
| WO | 2017136941 | A1 | 8/2017 |
| WO | 2017182930 | A2 | 10/2017 |
| WO | 2017208256 | A1 | 12/2017 |
| WO | 2018072017 | A1 | 4/2018 |
| WO | 2018072034 | A1 | 4/2018 |
| WO | 2018157148 | A1 | 8/2018 |
| WO | 2018161112 | A1 | 9/2018 |
| WO | 2018234876 | A1 | 12/2018 |
| WO | 2019073261 | A1 | 4/2019 |
| WO | 2019086546 | A1 | 5/2019 |
| WO | 2019211822 | A1 | 11/2019 |
| WO | 2020028232 | A1 | 2/2020 |
| WO | 2020074910 | A1 | 4/2020 |
| WO | 2020104505 | A1 | 5/2020 |
| WO | 2020104506 | A1 | 5/2020 |
| WO | 2020104511 | A1 | 5/2020 |
| WO | 2020115708 | A1 | 6/2020 |
| WO | 2020118260 | A1 | 6/2020 |
| WO | 2020201666 | A1 | 10/2020 |
| WO | 2020232550 | A1 | 11/2020 |
| WO | 2020232552 | A1 | 11/2020 |
| WO | 2020232555 | A1 | 11/2020 |
| WO | 2020236930 | A1 | 11/2020 |
| WO | 2020245609 | A1 | 12/2020 |
| WO | 2021026406 | A1 | 2/2021 |
| WO | 2021046376 | A1 | 3/2021 |
| WO | 2021062079 | A1 | 4/2021 |
| WO | 2021062519 | A1 | 4/2021 |
| WO | 2021080974 | A1 | 4/2021 |
| WO | 2021101967 | A1 | 5/2021 |
| WO | 2021101970 | A1 | 5/2021 |
| WO | 2021114534 | A1 | 6/2021 |
| WO | 2021228162 | A1 | 11/2021 |
| WO | 2021238856 | A1 | 12/2021 |

OTHER PUBLICATIONS

Restriction requirement issued on Sep. 12, 2024 in connection with U.S. Appl. No. 18/196,023, 7 pages.

Examiner Report issued on Dec. 4, 2024 in connection with Canadian Patent Application No. 3,158,266, 3 pages.

Non-Final Office Action issued on Dec. 4, 2024 in connection with U.S. Appl. No. 17/766,384, 9 pages.

Communication pursuant to Article 94(3) EPC issued on Jul. 3, 2024 in connection with European Patent Application No. 20810281.4, 8 pages.

Corrected Notice of Allowability issued on Jul. 19, 2023 in connection with U.S. Appl. No. 16/440,655, 9 pages.

Examiner's Report issued on Dec. 5, 2023 in connection with Canadian Patent Application No. 3,158,266, 3 pages.

Examiner's Report issued on Apr. 18, 2024 in connection with Canadian Patent Application No. 3,157,206, 4 pages.

Examiner's Report issued on Nov. 29, 2023 in connection with Canadian Patent Application No. 3,157,206, 3 pages.

Final Office Action issued on Feb. 9, 2021 in connection with U.S. Appl. No. 16/440,655, 39 pages.

Final Office Action issued on May 1, 2024 in connection with U.S. Appl. No. 17/526,489, 8 pages.

Non-Final Office Action issued on Oct. 15, 2020 in connection with U.S. Appl. No. 16/440,655, 41 pages.

Notice of Allowability issued on Nov. 16, 2017 in connection with U.S. Appl. No. No. 14/276,739, 3 pages.

Notice of Allowance issued on Aug. 11, 2023 in connection with U.S. Appl. No. 15/922,526, 11 pages.

Restriction Requirement issued on Nov. 17, 2023 in connection with U.S. Appl. No. 17/526,489, 6 pages.

Supplemental Notice of Allowability issued on Feb. 14, 2018 in connection with U.S. Appl. No. 14/276,739, 2 pages.

Examiner's Report issued on Jan. 2, 2024 in connection with CA patent application No. 3,141,358, 4 pages.

Non-Final Office Action issued on Dec. 21, 2023 in connection with U.S. Appl. No. 17/526,489, 11 pages.

Non-Final Office Action issued on Sep. 7, 2021 in connection with U.S. Appl. No. 16/440,691, 33 pages.

Non-Final Office Action issued on Sep. 7, 2021 in connection with U.S. Appl. No. 16/440,717, 31 pages.

Non-Final Office Action issued Sep. 7, 2021 in connection with U.S. Appl. No. 15/922,526, 22 pages.

Restriction Requirement issued on Jul. 17, 2020 in connection with U.S. Appl. No. 16/440,655, 9 pages.

Final Office Action issued on Apr. 4, 2022 in connection with U.S. Appl. No. 15/922,526, 24 pages.

Final Office Action issued on Apr. 4, 2022 in connection with U.S. Appl. No. 16/440,655, 39 pages.

Final Office Action issued on Apr. 4, 2022 in connection with U.S. Appl. No. 16/440,717, 20 pages.

International Preliminary Report on Patentability issued on Feb. 8, 2022 in connection with International Patent Application PCT/CA2020/050684, 11 pages.

Written Opinion issued on Dec. 14, 2021 in connection with International PCT application No. PCT/CA2020/050684, 7 pages.

Non-Final Office Action issued Mar. 14, 2022 in connection with U.S. Appl. No. 17/611,262, 36 pages.

Final Office Action issued on Apr. 4, 2022 in connection with U.S. Appl. No. 16/440,691, 31 pages.

Non-Final Office Action issued on Sep. 9, 2022 in connection with U.S. Appl. No. 16/440,691, 32 pages.

Non-Final Office Action issued on Sep. 9, 2022 in connection with U.S. Appl. No. 16/440,655, 39 pages.

Notice of Allowance issued on Sep. 9, 2022 in connection with U.S. Appl. No. 16/440,717, 18 pages.

Final Office Action issued on Sep. 8, 2022 in connection with U.S. Appl. No. 17/611,262, 17 pages.

(56) References Cited

OTHER PUBLICATIONS

Examiner Report issued on Mar. 3, 2023 in connection with Canadian Patent Application No. 3,140,505, 3 pages.
Extended European Search Report issued on Jan. 5, 2023 in connection with European Patent Application No. 20810281.4, 10 pages.
Non-Final Office Action issued on Jan. 10, 2023 in connection with U.S. Appl. No. 15/922,526, 22 pages.
Final Office Action issued on Jan. 10, 2023 in connection with U.S. Appl. No. 16/440,655, 38 pages.
Notice of Allowance issued on Feb. 16, 2023 in connection with U.S. Appl. No. 17/611,262, 9 pages.
Final Office Action issued on Jan. 10, 2023 in connection with U.S. Appl. No. 16/440,691, 33 pages.
Notice of Allowance issued on Jun. 7, 2023 in connection with U.S. Appl. No. 16/440,691, 17 pages.
Notice of Allowance issued on Jun. 14, 2023 in connection with U.S. Appl. No. 16/440,691, 15 pages.
Notice of Allowance issued on Jun. 16, 2023 in connection with U.S. Appl. No. 16/440,655, 11 pages.
Final Office Action issued on Mar. 12, 2025 in connection with U.S. Appl. No. 17/766,384, 13 pages.
Notice of Allowance issued on Mar. 26, 2025 in connection with U.S. Appl. No. 18/196,023, 9 pages.
Examiner-Initiated Interview Summary issued on Mar. 26, 2025 in connection with U.S. Appl. No. 18/196,023, 1 page.
Non-Final Office Action issued on Mar. 18, 2025 in connection with U.S. Appl. No. 17/612,553, 25 pages.
Advisory Action issued on Jun. 14, 2016 in connection with U.S. Appl. No. 14/276,739, 3 pages.
Advisory Action issued on Mar. 21, 2017 in connection with U.S. Appl. No. 14/276,739, 3 pages.
Applicant-Initiated Interview Summary issued on Aug. 15, 2017 in connection with U.S. Appl. No. 14/276,739, 3 pages.
Applicant-Initiated Interview Summary issued on Jun. 13, 2016 in connection with U.S. Appl. No. 14/276,739, 2 pages.
Notice of Allowance issued on Feb. 14, 2018 in connection with U.S. Appl. No. 14/276,739, 2 pages.
Notice of Allowance issued on Nov. 16, 2017 in connection with U.S. Appl. No. 14/276,739, 3 pages.
Notice of Allowance issued on Nov. 9, 2017 in connection with U.S. Appl. No. 14/276,739, 7 pages.
Office Action issued on Aug. 24, 2015 in connection with U.S. Appl. No. 14/276,739, 5 pages.
Office Action issued on Dec. 9, 2016 in connection with U.S. Appl. No. 14/276,739, 5 pages.
Office Action issued on Jul. 20, 2016 in connection with U.S. Appl. No. 14/276,739, 5 pages.
Office Action issued on Mar. 7, 2016 in connection with U.S. Appl. No. 14/276,739, 6 pages.
Office Action issued on May 1, 2017 in connection with U.S. Appl. No. 14/276,739, 7 pages.
Restriction Requirement issued on Jun. 9, 2015 in connection with U.S. Appl. No. 14/276,739, 5 pages.
Jacobsen et al., Interconnected self-propagating photopolymer wave-guides: An alternative to stereolitography for rapid formation of lattice-based open-cellelar materials:, Twenty-First AnnualInternational Solid Freeform Fabrication Symposium, Austin, TX Aug. 9, 2010, 846-853.
Jul. 31, 2015—(PCT)—International Search Report and Written Opinion—App PCT/US15/30383.
Jan. 22, 2018—(EP)—European Search Report—App. No. 15793488.6.
Sep. 20, 2017—(CA) Examiner's Report—App. No. 2,949,062.
Jun. 5, 2020—(US) Non-Final Office Action—U.S. Appl. No. 15/922,526.
Advisory Action issued on Mar. 17, 2021 in connection with U.S. Appl. No. 15/922,526, 3 pages.
Examiner Report issued on Nov. 25, 2020 in connection with Canadian Patent Application No. 3054547, 5 pages.
Examiner Report issued on Nov. 25, 2020 in connection with Canadian Patent Application No. 3054536, 5 pages.
Examiner Report issued on Nov. 24, 2020, in connection with Canadian Patent Application No. 3,054,525, 5 pages.
Examiner Report issued on Nov. 25, 2020 in connection with Canadian Patent Application No. 3054530, 7 pages.
Examiner's Report issued on Jul. 29, 2019 in connection with Canadian Patent Application 2,949,062, 3 pages.
Final Office Action issued on Nov. 23, 2020 in connection with U.S. Appl. No. 15/922,526, 17 pages.
Final Office Action issued on Feb. 9, 2021 in connection with United States U.S. Appl. No. 16/440,691, 41 pages.
Final Office Action issued on Feb. 9, 2021 in connection with U.S. Appl. No. 16/440,717, 35 pages.
International Search Report and Written Opinion issued on Aug. 19, 2020 in connection with International Patent Application PCT/CA2020/050689, 11 pages.
International Search Report issued on Aug. 20, 2020 in connection with International PCT application No. PCT/CA2020/050683, 5 pages.
International Search Report issued on Aug. 21, 2020 in connection with International PCT application No. PCT/CA2020/050686, 4 pages.
International Search Report issued on Aug. 25, 2020 in connection with International PCT application No. PCT/CA2020/050684, 6 pages.
Non-Final Office Action issued on Jun. 19, 2019 in connection with United States U.S. Appl. No. 15/922,526, 15 pages.
Non-Final Office Action issued on Jun. 5, 2020 in connection with United States U.S. Appl. No. 15/922,526, 16 pages.
Non-Final Office Action issued on Oct. 15, 2020 in connection with United States U.S. Appl. No. 16/440,691, 33 pages.
Non-Final Office Action issued on Oct. 15, 2020 in connection with United States U.S. Appl. No. 16/440,717, 37 pages.
Restriction Requirement issued on Jul. 20, 2020 in connection with United States U.S. Appl. No. 16/440,691, 6 pages.
Restriction Requirement issued on Mar. 5, 2019 in connection with U.S. Appl. No. 15/922,526, 6 pages.
Written Opinion issued on Aug. 20, 2020 in connection with International PCT application No. PCT/CA2020/050683, 8 pages.
Written Opinion issued on Aug. 21, 2020 in connection with International PCT application No. PCT/CA2020/050686, 5 pages.
Written Opinion issued on Aug. 25, 2020 in connection with International PCT application No. PCT/CA2020/050684, 7 pages.
Wang, X. et al., 3D printing of polymer matrix composites: A review and prospective, Composites Part B, 2017, vol. 110, pp. 442-458.
Wirth, D. M. et al. Highly expandable foam for litographic 3D printing, ACS Appl. Mater. Interfaces, 2020, 12 pages 19033-19043.
Examiner Report issued on Apr. 27, 2021 in connection with Canadian Patent Application No. 3,054,525, 3 pages.
Examiner Report issued on Apr. 27, 2021 in connection with Canadian Patent Application No. 3,054,530, 4 pages.
Examiner Report issued on Apr. 27, 2021 in connection with Canadian Patent Application No. 3,054,536, 5 pages.
Examiner Report issued on Apr. 27, 2021 in connection with Canadian Patent Application No. 3,054,547, 5 pages.
Examiner Report issued on Aug. 2, 2021 in connection with Canadian Patent Application No. 3,054,530, 3 pages.
International Preliminary Report on Patentability issued on Oct. 1, 2021 in connection with International Patent Application PCT/CA2020/050689, 31 pages.
International Preliminary Report on Patentability issued on Sep. 14, 2021 in connection with International Patent Application PCT/CA2020/050683, 17 pages.
International Preliminary Report on Patentability issued on Sep. 3, 2021 in connection with International Patent Application PCT/CA2020/050686, 54 pages.
Corrected Notice of Allowability issued on Apr. 14, 2025 in connection with U.S. Appl. No. 18/196,023, 2 pages.
Examiner Report issued on Jul. 8, 2025 in connection with Canadian Patent Application No. 3141358, 5 pages.

(56) References Cited

OTHER PUBLICATIONS

Intention to grant issued by the European Patent Office on Jun. 11, 2025 in connection with European Patent Application No. 20810281.4, 5 pages.
Applicant Initiated Interview Summary issued on May 9, 2025 in connection with U.S. Appl. No. 17/766,384, 3 pages.
Non-Final Office Action issued on Jul. 1, 2025 in connection with U.S. Appl. No. 17/766,384, 15 pages.
Oct. 17, 2025—(CA) Office Action—App 3,158,266.
Oct. 21, 2025—(US) Final Office Action—U.S. Appl. No. 17/612,533.
Protest under 37 CFR 1.291 filed with the United States Patent and Trademark Office on Sep. 25, 2025 in connection with U.S. Appl. No. 18/788,214, 5 pages.
Yakacki et al., "Ultra-Dissipative Padding Made form Liquid-Crystal Elastomers". Jan. 12, 2018, https://www.nfl.com/news/nfl-reveals-1st-and-future-safety-innovation-winners-0ap3000000913820.
NFL 1st & Future Award published on Feb. 3, 2018, https://www.nfl.com/playerhealthandsafety/equipment-and- innovation/1st-and-future/nfl-comcast-nbc-mayo-clinic-announce-winners-1st-future-super-bowl-competition.
Meet the 2018 Winners of the NFL's 1st and Future Start-Up Competition published on Mar. 23, 2018. https://www.nfl.com/playerhealthandsafety/equipment-and-innovation/1st-and-future/meet-the 2018-winners-of-the-nfls-1st-and-future-start-up-competition.
Meet the Winners of HeadHealth TECH Challenge III published on May 8, 2018. https://www.nfl.com/playerhealthandsafety/equipment-and-innovation/headhealthtech/meet-the-winners-of-headhealthtech-challenge-iii.

* cited by examiner

SPORTING GOODS INCLUDING MICROLATTICE STRUCTURES

CROSS-REFERENCE TO RELATED APPLICATIONS

This application is a continuation of U.S. patent application Ser. No. 15/922,526, filed Mar. 15, 2018, which is a continuation of U.S. patent application Ser. No. 14/276,739, filed May 13, 2014, now U.S. Pat. No. 9,925,440, issued May 13, 2014, which are incorporated herein by reference in its entirety for any and all non-limiting purposes.

BACKGROUND

Lightweight foam materials are commonly used in sporting good implements, such as hockey sticks and baseball bats, because their strength-to-weight ratios provide a solid combination of light weight and performance. Lightweight foams are often used, for example, as interior regions of sandwich structures to provide lightweight cores of sporting good implements.

Foamed materials, however, have limitations. For example, foamed materials have homogeneous, isotropic properties, such that they generally have the same characteristics in all directions. Further, not all foamed materials can be precisely controlled, and their properties are stochastic, or random, and not designed in any particular direction. And because of their porosity, foamed materials often compress or lose strength over time.

Some commonly used foams, such as polymer foams, are cellular materials that can be manufactured with a wide range of average-unit-cell sizes and structures. Typical foaming processes, however, result in a stochastic structure that is somewhat limited in mechanical performance and in the ability to handle multifunctional applications.

SUMMARY

A sporting good implement, such as a hockey stick or ball bat, includes a main body. The main body may be formed from multiple layers of a structural material, such as a fiber-reinforced composite material. One or more microlattice structures may be positioned between layers of the structural material. One or more microlattice structures may additionally or alternatively be used to form the core of a sporting good implement, such as a hockey-stick blade. The microlattice structures improve the performance, strength, or feel of the sporting good implement. Other features and advantages will appear hereinafter.

BRIEF DESCRIPTION OF THE DRAWINGS

In the drawings, wherein the same reference number indicates the same element throughout the views.

DETAILED DESCRIPTION OF THE DRAWINGS

Figure 1:
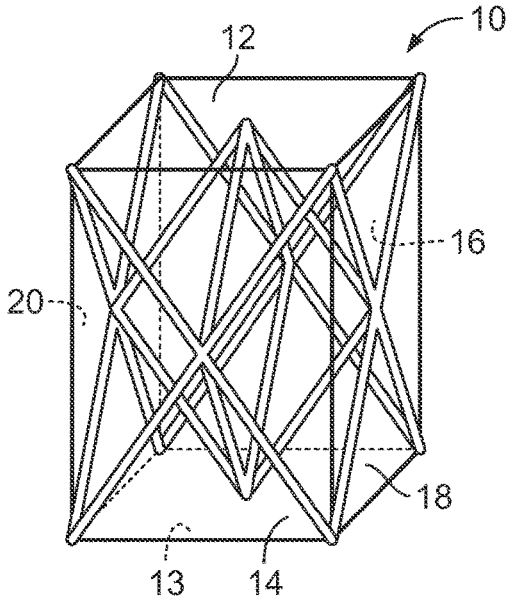
FIG. 1 is a perspective view of a microlattice unit cell, according to one embodiment.

Various embodiments of the invention will now be described. The following description provides specific details for a thorough understanding and enabling description of these embodiments. One skilled in the art will understand, however, that the invention may be practiced without many of these details. Additionally, some well-known structures or functions may not be shown or described in detail so as to avoid unnecessarily obscuring the relevant description of the various embodiments.

The terminology used in the description presented below is intended to be interpreted in its broadest reasonable manner, even though it is being used in conjunction with a detailed description of certain specific embodiments of the invention. Certain terms may even be emphasized below; however, any terminology intended to be interpreted in any restricted manner will be overtly and specifically defined as such in this detailed description section.

Where the context permits, singular or plural terms may also include the plural or singular term, respectively. Moreover, unless the word "or" is expressly limited to mean only a single item exclusive from the other items in a list of two or more items, then the use of "or" in such a list is to be interpreted as including (a) any single item in the list, (b) all of the items in the list, or (c) any combination of items in the list. Further, unless otherwise specified, terms such as "attached" or "connected" are intended to include integral connections, as well as connections between physically separate components.

Micro-scale lattice structures, or "microlattice" structures, include features ranging from tens to hundreds of microns. These structures are typically formed from a three dimensional, interconnected array of self-propagating photopolymer waveguides. A microlattice structure may be formed, for example, by directing collimated ultraviolet light beams through apertures to polymerize a photomonomer material. Intricate three-dimensional lattice structures may be created using this technique.

In one embodiment, microlattice structures may be formed by exposing a two-dimensional mask, which includes a pattern of circular apertures and covers a reservoir containing an appropriate photomonomer, to collimated ultraviolet light. Within the photomonomer, self-propagating photopolymer waveguides originate at each aperture in the direction of the ultraviolet collimated beam and polymerize together at points of intersection. By simultaneously forming an interconnected array of these fibers in three-dimensions and removing the uncured monomer, unique three-dimensional, lattice-based, open-cellular polymer materials can be rapidly fabricated.

The photopolymer waveguide process provides the ability to control the architectural features of the bulk cellular material by controlling the fiber angle, diameter, and three-dimensional spatial location during fabrication. The general unit-cell architecture may be controlled by the pattern of circular apertures on the mask or the orientation and angle of the collimated, incident ultraviolet light beams.

The angle of the lattice members with respect to the exposure-plane angle are controlled by the angle of the incident light beam. Small changes in this angle can have a significant effect on the resultant mechanical properties of the material. For example, the compressive modulus of a microlattice material may be altered greatly with small angular changes within the microlattice structure.

Microlattice structures can provide improved mechanical performance (higher stiffness and strength per unit mass, for example), as well as an accessible open volume for unique multifunctional capabilities. The photopolymer waveguide process may be used to control the architectural features of the bulk cellular material by controlling the fiber angle, diameter, and three-dimensional spatial location during fabrication. Thus, the microlattice structure may be designed to provide strength and stiffness in desired directions to optimize performance with minimal weight.

This manufacturing technique is able to produce three-dimensional, open-cellular polymer materials in seconds. In addition, the process provides control of specific microlattice parameters that ultimately affect the bulk material properties. Unlike stereolithography, which builds up three-dimensional structures layer by layer, this fabrication technique is rapid (minutes to form an entire part) and can use a single two-dimensional exposure surface to form three-dimensional structures (with a thickness greater than 25 mm possible). This combination of speed and planar scalability opens up the possibility for large-scale, mass manufacturing. The utility of these materials range from lightweight energy-absorbing structures, to thermal-management materials, to bio-scaffolds.

A microlattice structure may be constructed by this method using any polymer that can be cured with ultraviolet light. Alternatively, the microlattice structure may be made of a metal material. For example, the microlattice may be dipped in a catalyst solution before being transferred to a nickel-phosphorus solution. The nickel-phosphorus alloy may then be deposited catalytically on the surface of the polymer struts to a thickness of around 100 nm. Once coated, the polymer is etched away with sodium hydroxide, leaving a lattice geometry of hollow nickel-phosphorus tubes.

The resulting microlattice structure may be greater than 99.99 percent air, and around 10 percent less dense than the lightest known aerogels, with a density of approximately 0.9 $mg/cm^3$. Thus, these microlattice structures may have a density less than 1.0 $mg/cm^3$. A typical lightweight foam, such as Airex C71, by comparison, has a density of approximately 60 $mg/cm^3$ and is approximately 66 times heavier.

Further, the microengineered lattice structure has remarkably different properties than a bulk alloy. A bulk alloy, for example, is typically very brittle. When the microlattice structure is compressed, conversely, the hollow tubes do not snap but rather buckle like a drinking straw with a high degree of elasticity. The microlattice can be compressed to half its volume, for example, and still spring back to its original shape. And the open-cell structure of the microlattice allows for fluid flow within the microlattice, such that a foam or elastomeric material, for example, may fill the air space to provide additional vibration damping or strengthening of the microlattice material.

The manufacturing method described above could be modified to optimize the size and density of the microlattice structure locally to add strength or stiffness in desired regions. This can be done by varying:

- the size of the apertures in the mask to locally alter the size of the elements in the lattice;
- the density of the apertures in the mask to locally alter the strength or dynamic response of the system; or
- the angle of the incident collimated light to change the angle of the elements, which affects the strength and stiffness of the material.

The manufacturing method could also be modified to include fiber reinforcement. For example, fibers may be arranged to be co-linear or co-planar with the collimated ultraviolet light beams. The fibers are submersed in the photomonomer resin and wetted out. When the ultraviolet light polymerizes the photomonomer resin, the resin cures and adheres to the fiber. The resulting microlattice structure will be extremely strong, stiff, and light.

FIGS. 1-8 illustrate some examples of microlattice unit cells and microlattice structures. FIG. 1 shows a square unit cell 10 with a top plane 12 and a bottom plane 13 defining the cell shape. This is a single cell that would be adjacent to other similar cells in a microlattice structure. The cell 10 is defined by a front plane 14, an opposing rear plane 16, a right-side plane 18, and a left-side plane 20. It will be used as a reference in the building of a microlattice structure using four collimated beams controlled by a mask with circular apertures to create a lattice structure with struts of circular cross section.

Figure 2:
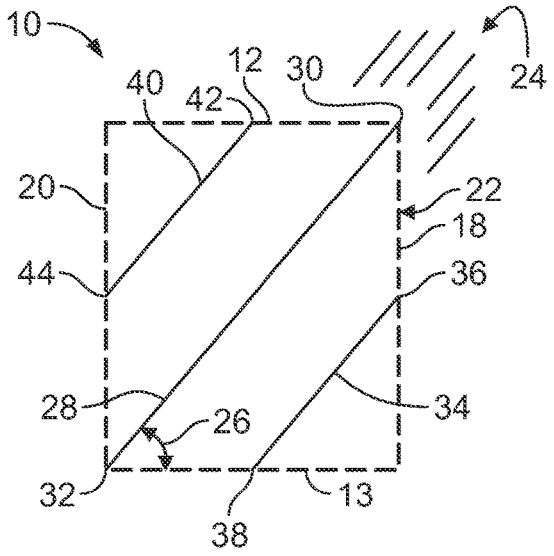
FIG. 2 is a side view of the unit cell of FIG. 1 with a collimated beam of light directed through an upper-right corner of the cell.

FIG. 2 shows a side view of the unit cell 10 with a dashed line 22 indicating the boundary of the cell 10. A collimated beam of light 24 is directed at an angle 26 controlled by a mask with apertures (not shown). A light beam 28 is oriented through an upper-right-corner node 30 and a lower-left-corner node 32. A parallel beam of light 34 is directed through a node 36 positioned on the center of right-side plane 18 and through a node 38 on the center of bottom plane 13. Similarly, a light beam 40 is directed through a node 42 positioned on the center of top plane 12 and through a node 44 positioned on the center of left-side plane 20. These light beams will polymerize the monopolymer material and fuse to other polymerized material.

Figure 3:
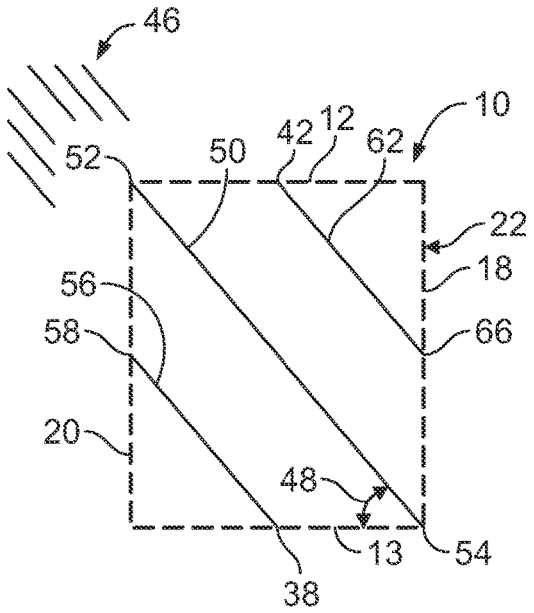
FIG. 3 is a side view of the unit cell of FIGS. 1 and 2 with a collimated beam of light directed through an upper-left corner of the cell.

FIG. 3 shows a side view of the unit cell 10 with a dashed line 22 indicating the boundary of the cell 10. A collimated beam of light 46 is directed at an angle 48 controlled by a mask with apertures (not shown). A light beam 50 is oriented through the upper-left-corner node 52 and lower-right-corner node 54. A parallel beam of light 56 is directed through a node 58 positioned on the center of left-side plane 20 and through a node 38 on the center of bottom plane 13. Similarly, a parallel light beam 62 is directed through a node 42 positioned on the center of top plane 12 and through a node 66 positioned on the center of right-side plane 18. These light beams will polymerize the monopolymer material and fuse to other polymerized material.

Figure 4:
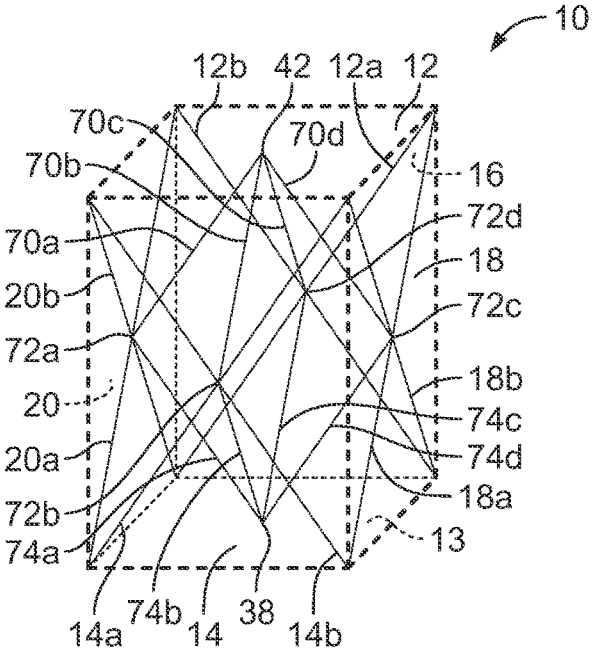
FIG. 4 is a perspective view of a microlattice unit cell resulting from repeating the processes illustrated in FIGS. 3 and 4, according to one embodiment.

This process is repeated for the other sets of vertical planes 12 and 14 resulting in the structure shown in FIG. 4. Long beams 14*a* and 14*b* on front plane 14 are parallel to respective beams 12*a* and 12*b* on rear plane 12. Long beams 18*a* and 18*b* on right plane 18 are parallel to respective beams 20*a* and 20*b* on left plane 20. Short beams 70*a*, 70*b*, 70*c*, and 70*d* connect at upper node 42 centered on top plane 12, and are directed to the center-face nodes 72*a*, 72*b*, 72*c*, and 72*d*. Similarly, short beams 74*a*, 74*b*, 74*c*, and 74*d* connect at lower node 38 centered on bottom plane 13 and connect to the short beams 70*a*, 70*b*, 70*c*, and 70*d* and center-face nodes 72*a*, 72*b*, 72*c*, and 72*d*.

Figure 5:
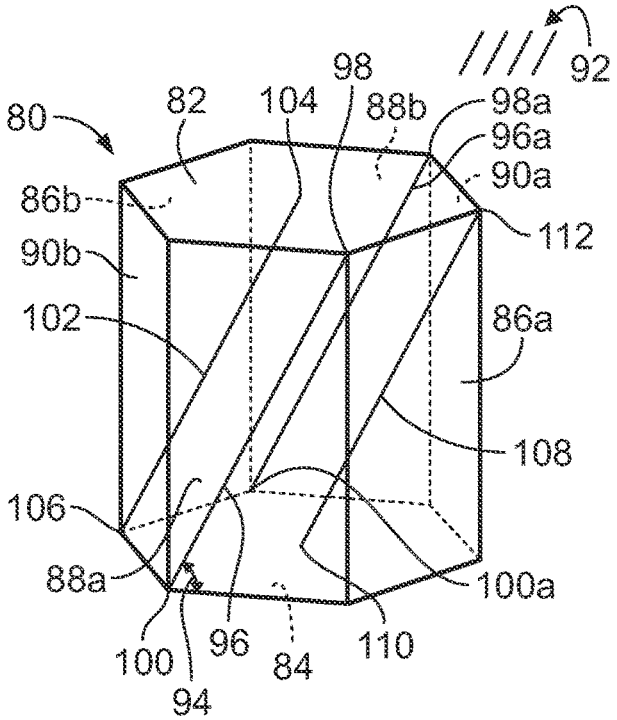
FIG. 5 is a perspective view of a hexagonal unit cell with a collimated beam of light directed through an upper-right region of the cell, according to one embodiment.

Alternatively, a hexagonal shaped cell can be constructed as shown in FIG. 5. A hexagonal unit cell 80 is defined by a hexagonal shaped top plane 82 and opposing bottom plane 84. Vertical plane 86*a* is opposed by vertical plane 86*b*. Vertical plane 88*a* is opposed by vertical plane 88*b*. Vertical plane 90*a* is opposed by vertical plane 90*b*. A collimated light beam 92 is directed at an angle 94 controlled by a mask with apertures (not shown). A beam 96 is formed through upper node 98 and lower node 100 on vertical plane 88*a*. Similarly, a beam 96*a* is formed through upper node 98*a* and lower node 100*a* on vertical plane 88*b*. A face-to-node beam 102 that is parallel to beams 96 and 96*a* is formed from the center 104 of top face 82 to the lower node 106. Another face-to-node beam 108 that is parallel to beams 96, 96*a*, and 102 is formed from the center 110 of bottom plane 84 to upper node 112.

Figure 6:
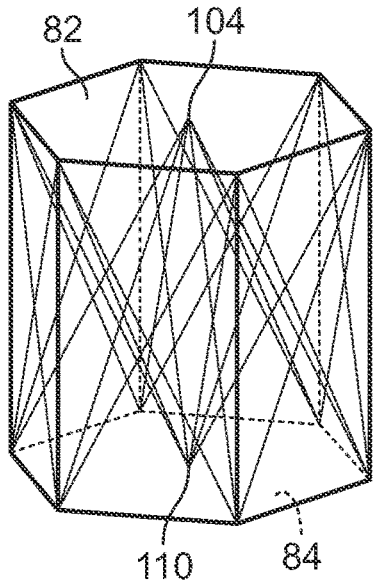
FIG. 6 is a perspective view of a hexagonal microlattice unit cell resulting from repeating the process illustrated in FIG. 5, according to one embodiment.

This process is repeated for the remaining two sets of vertically opposed planes to create the cell structure shown in FIG. 6. The resulting structure has two sets of node-to-node beams in each of the six vertical planes. It also has six face-to-node beams connected at the center node 104 of top plane 82, and six face-to-node beams connected at the center node 110 of bottom plane 84.

Cell structures 10 and 80 shown in FIGS. 4 and 6, respectively, are merely examples of structures that can be created. The cell geometry may vary according to the lattice structure desired. And the density of the microlattice structure may be varied by changing the angle of the beams.

Figure 7:
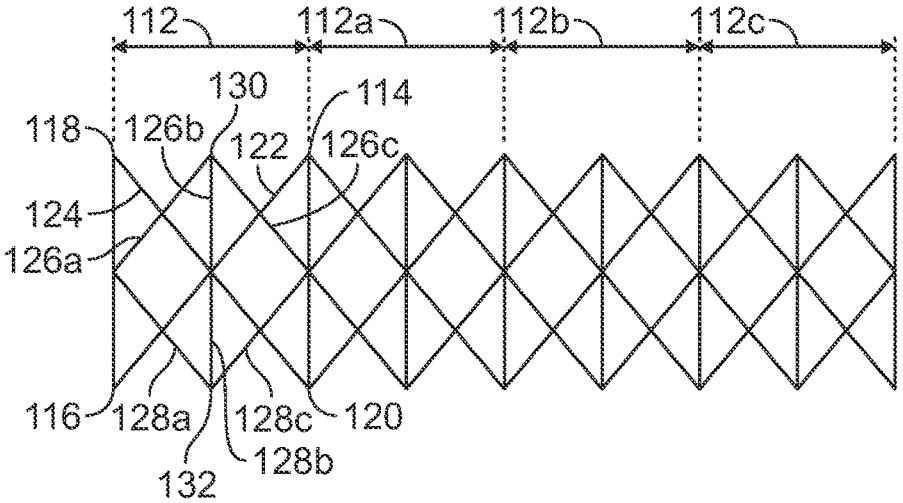
FIG. 7 is a side view of multiple microlattice unit cells of uniform density connected in a row, according to one embodiment.

FIG. 7 is a side view of multiple square cells, such as multiple unit cells 10, connected in a row. This simplified view shows the regular spacing between beams, and the equal cell dimensions. Dimension 112 denotes the width of a single cell unit. Dimension 112=112*a*=112*b*=112*c*, such that all cells are of uniform size and dimensions. The long beam 122 connects corner node 114 to corner node 116. Similarly, long beam 124 connects corner nodes 118 and 120. Short beams 126*a*, 126*b*, 126*c*, and a fourth short beam (not visible) connect to upper-center-face node 130. Similarly, short beams 128*a*, 128*b*, 128*c*, and a fourth short beam (not visible) connect to lower-center-face node 132.

Figure 8:
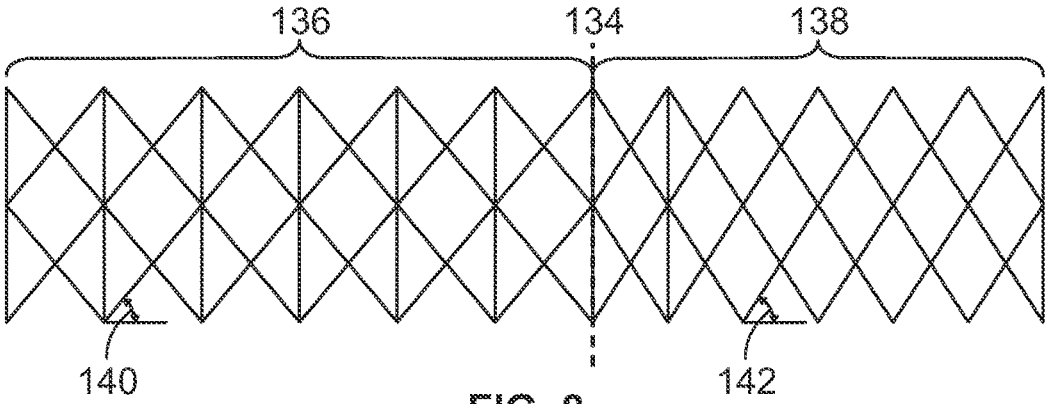
FIG. 8 is a side view of multiple microlattice unit cells of varying density connected in a row, according to one embodiment.

FIG. 8 represents an alternative design in which the density of the microlattice structure varies. To the left of line 134, the microlattice structure 136 has spacing as shown in FIG. 7. To the right of line 134, the microlattice structure 138 has spacing that is tighter and more condensed. In addition, the angle 142 of the beams is greater for structure 138 than the angle 140 for structure 136. Thus, structure 138 provides more compression resistance than structure 136.

Other design alternatives exist to vary the compression resistance of the microlattice structure. For example, the size of the lattice beams may vary by changing the aperture size in the mask. Thus, there are multiple ways to vary and optimize the local stiffness of the microlattice structure.

The microlattice structures described above may be used in a variety of sporting-good applications. For example, one or more microlattice structures may be used as the core of a hockey-stick blade. The stiffness and strength of the microlattice may be designed to optimize the performance of the hockey-stick blade. For example, the density of the microlattice may be higher in the heel area of the blade—where pucks are frequently impacted when shooting slap-shots or trapping pucks-than in the toe region or mid-region of the blade. Further, the microlattice may be more open or flexible toward the toe of the blade to enable a faster wrist shot or to enhance feel and control of the blade.

One or more microlattice structures may also be used to enhance the laminate strength in a hockey-stick shaft, bat barrel, or bat handle. Positioning the microlattice as an interlaminar ply within a bat barrel, for example, could produce several benefits. The microlattice can separate the inner barrel layers from the outer barrel layers, yet allow the outer barrel to deflect until the microlattice reaches full compression, then return to a neutral position. The microlattice may be denser in the sweet-spot area where the bat produces the most power, and more open in lower-power regions to help enhance bat power away from the sweet spot.

For a hockey-stick shaft or bat handle, the microlattice may be an interlaminar material that acts like a sandwich structure, effectively increasing the wall thickness of the laminate, which increases the stiffness and strength of the shaft or handle.

One or more microlattice structures may also be used in or as a connection material between a handle and a barrel of a ball bat. Connecting joints of this nature have traditionally been made from elastomeric materials, as described, for example, in U.S. Pat. No. 5,593,158, which is incorporated herein by reference. Such materials facilitate relative movement between the bat barrel and handle, thereby absorbing the shock of impact and increasing vibration damping.

A microlattice structure used in or as a connection joint provides an elastic and resilient intermediary that can absorb compression loads and return to shape after impact. In addition, the microlattice can be designed with different densities to make specific zones of the connection joint stiffer than others to provide desired performance benefits. The microlattice structure also offers the ability to tune the degree of isolation of the barrel from the handle to increase the amount of control and damping without significantly increasing the weight of the bat.

Microlattice structures may also be used in helmet liners to provide shock absorption, in bike seats as padding, or in any number of other sporting-good applications. FIGS. 9-16 illustrate some specific examples.

Figure 9:
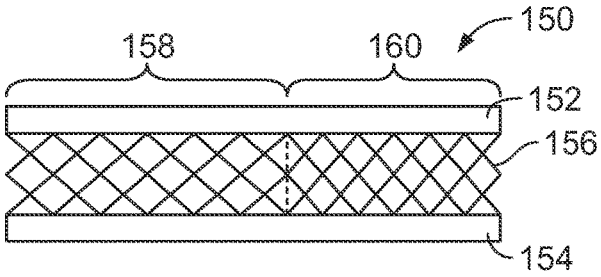
FIG. 9 is a side-sectional view of a hockey-stick blade including a microlattice core structure, according to one embodiment.

FIG. 9 shows a sandwich structure of a hockey-stick blade 150. The top laminate 152 and bottom laminate 154 of the blade 150 may be constructed of fiber-reinforced polymer resin, such as carbon-fiber-reinforced epoxy, or of another suitable material. A microlattice core 156 is positioned between the top and bottom laminates 152, 154. The microlattice core 156 may optionally vary in density such that it is lighter and more open in zone 158 (for example, at the toe-end of the blade), and denser and stronger in zone 160 (for example, at the heel-end of the blade).

Figure 10:
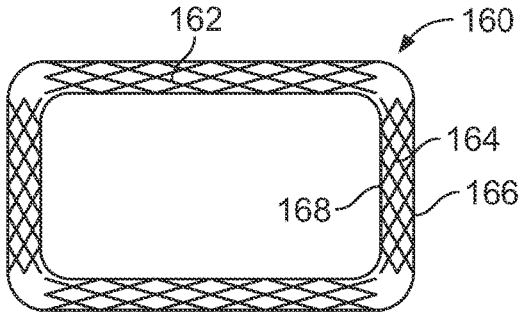
FIG. 10 is a top-sectional view of a hockey-stick shaft including a microlattice core structure between exterior and interior laminates of the shaft, according to one embodiment.

FIG. 10 shows a hockey-stick shaft 160 including a microlattice structure 162 acting as a core between an exterior laminate 166 and an interior laminate 168. Optionally, the microlattice 162 structure may have increased density in one or more shaft regions, such as in region 164 where more impact forces typically occur. Using the microlattice in this manner maintains sufficient wall thickness to resist compressive forces, yet reduces the overall weight of the hockey stick shaft relative to a traditional shaft.

Figure 11:
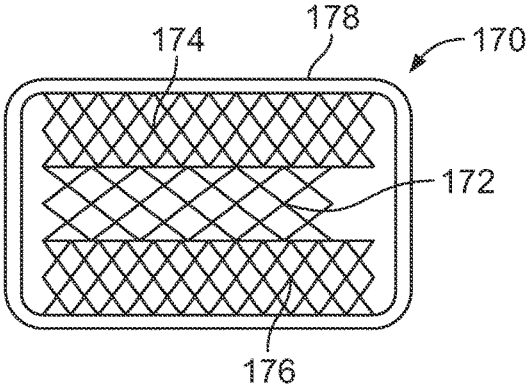
FIG. 11 is a top-sectional view of a hockey-stick shaft including a microlattice core structure in an interior cavity of the shaft, according to one embodiment.

FIG. 11 shows a hockey-stick shaft 170 with a microlattice structure 172 in an interior cavity of the shaft 170. In this embodiment, the microlattice structure is denser in regions 174 and 176 than in the central region 172. The microlattice structure is oriented in this manner to particularly resist compressive forces directed toward the larger dimension 178 of the shaft 170.

Figure 12:
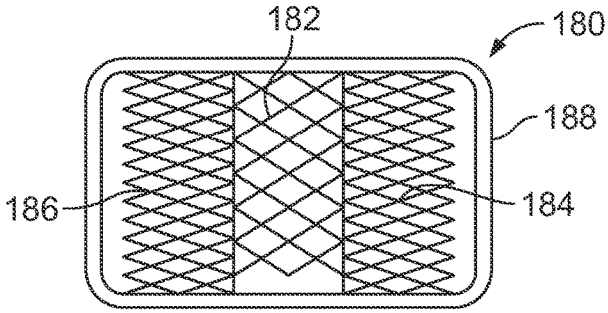
FIG. 12 is a top-sectional view of a hockey-stick shaft including a microlattice core structure in an interior cavity of the shaft, according to another embodiment.

FIG. 12 shows an alternative embodiment of a hockey-stick shaft 180 with a microlattice structure 182 in an interior cavity of the shaft. In this embodiment, the microlattice structure is more dense in regions 184 and 186 than in the central region 182. The microlattice structure is oriented in this manner to particularly resist compressive forces directed toward the smaller dimension 188 of the shaft 180.

Figure 13:
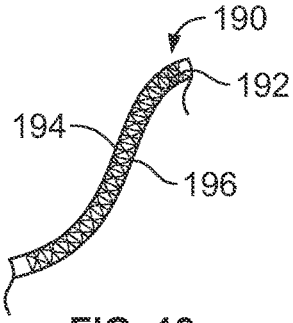
FIG. 13 is a side-sectional view of a portion of a hockey-skate boot including a microlattice core structure between exterior and interior layers of boot material.

FIG. 13 shows a cross section of a portion of a hockey skate boot 190. A microlattice structure 192 is sandwiched between the exterior material 194 and interior material 196 of the boot. The microlattice structure 192 may be formed as a net-shape contour, or formed between the exterior material 194 and the interior material 196. The exterior material 194 and interior material 196 may be textile-based, injection molded, a heat formable thermoplastic, or any other suitable material.

Figure 14:
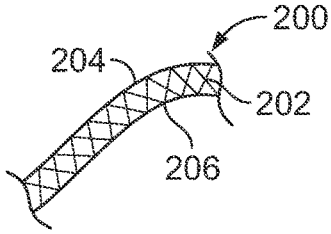
FIG. 14 is a side-sectional view of a portion of a sports helmet including a microlattice core structure between exterior and interior layers of the helmet.

FIG. 14 shows a cross section of a portion of a helmet shell 200. A microlattice structure 202 is sandwiched between the exterior material 204 and interior material 206 of the helmet. The microlattice structure 202 may be created as a net-shape contour, or formed between the exterior material 204 and the interior material 206. The exterior material 204 and interior material 206 may be textile-based, injection molded, a heat formable thermoplastic, or any other suitable material. The interior material 206 may optionally be a very light fabric, depending on the density and design of the microlattice structure 202. The microlattice structure 202 may optionally be a flexible polymer that is able to deform and recover, absorbing impact forces while offering good comfort.

Figure 15:
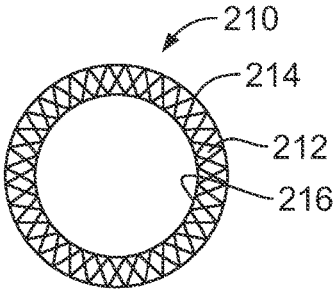
FIG. 15 is a top-sectional view of a bat barrel including a microlattice core structure between exterior and interior layers of the bat barrel.

FIG. 15 shows a cross-sectional view of a bat barrel 210 with a microlattice structure 212 sandwiched between an exterior barrel layer or barrel wall 214 and an interior barrel layer or barrel wall 216. The microlattice structure 212 may be formed as a straight panel that is rolled into the cylindrical shape of the barrel, or it may be formed as a cylinder. The microlattice structure 212 is able to limit the deformation of the exterior barrel wall 214 and to control the power of the bat while facilitating a light weight. The microlattice structure 212 may additionally or alternatively be used in the handle of the bat in a similar manner.

Figure 16:
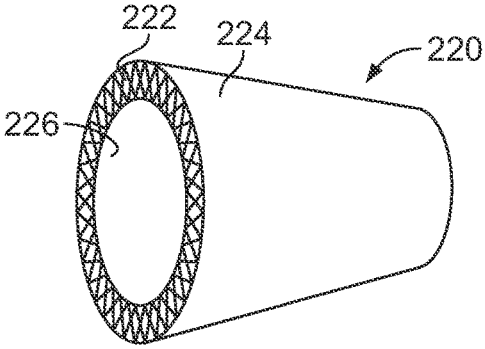
FIG. 16 is a perspective, partial-sectional view of a ball-bat joint including a microlattice core structure between exterior and interior layers of the joint.

FIG. 16 shows a conical joint 220 that may be used to connect a bat handle to a bat barrel. A microlattice structure 222 is sandwiched or otherwise positioned between an exterior material 224 and interior material 226 of the joint 220. The joint 220 may be bonded to the barrel and the handle of the bat or it may be co-molded in place. The barrel and handle may be a composite material, a metal, or any other suitable material or combination of materials. The microlattice structure 222 provides efficient movement of the barrel relative to the handle, and it further absorbs impact forces and dampens vibrations.

Any of the above-described embodiments may be used alone or in combination with one another. Further, the described items may include additional features not described herein. While several embodiments have been shown and described, various changes and substitutions may of course be made, without departing from the spirit and scope of the invention. The invention, therefore, should not be limited, except by the following claims and their equivalents.

We claim:

1. A sport helmet comprising:

a first surface and a second surface opposite one another; and a lattice formed of flexible polymeric material, configured to deform from an initial shape upon an impact on the sport helmet and recover the initial shape thereafter to absorb at least part of the impact;

wherein: the lattice comprises a regular geometrical arrangement of structural members that are formed of the flexible polymeric material, intersect one another at nodes, are integral and polymerized together at the nodes, and have designed dimensions, orientations and positions relative to one another individually controlled during formation of the structural members from the flexible polymeric material; and respective ones of the nodes of the lattice are spaced from one another in three orthogonal directions that include a thickness-wise direction of the sport helmet from the first surface of the sport helmet to the second surface of the sport helmet.

2. The sport helmet of claim 1, comprising a liner that comprises the lattice.

3. The sport helmet of claim 1, wherein a spacing of the structural members of the lattice is variable.

4. The sport helmet of claim 1, wherein respective ones of the structural members of the lattice vary in size.

5. The sport helmet of claim 1, wherein respective ones of the structural members of the lattice vary in orientation.

6. The sport helmet of claim 1, wherein a resistance to compression of the lattice is variable.

7. The sport helmet of claim 1, wherein a stiffness of the lattice is variable.

8. The sport helmet of claim 1, wherein a first zone of the lattice is stiffer than a second zone of the lattice.

9. The sport helmet of claim 8, wherein: a third zone of the lattice is stiffer than the second zone of the lattice; and the second zone of the lattice is disposed between the first zone of the lattice and the third zone of the lattice.

10. The sport helmet of claim 1, wherein a first zone of the lattice is more open than a second zone of the lattice.

11. The sport helmet of claim 10, wherein: a third zone of the lattice is less open than the first zone of the lattice; and the first zone of the lattice is disposed between the second zone of the lattice and the third zone of the lattice.

12. The sport helmet of claim 1, comprising: a first layer adjacent to the lattice and constituting at least part of the first surface of the sport helmet; and a second layer adjacent to the lattice and constituting at least part of the second surface of the sport helmet.

13. The sport helmet of claim 12, wherein the first layer is injection-molded.

14. The sport helmet of claim 13, wherein the second layer comprises textile material.

15. The sport helmet of claim 12, wherein a material of the first layer and a material of the second layer are different.

16. The sport helmet of claim 1, wherein the lattice is curved.

17. The sport helmet of claim 1, comprising filling material that fills at least part of hollow space of the lattice.

18. The sport helmet of claim 17, wherein the filling material comprises foam.

19. The sport helmet of claim 17, wherein the filling material comprises elastomeric material.

20. The sport helmet of claim 17, wherein the filling material is configured to dampen vibrations.

21. The sport helmet of claim 1, wherein the lattice is optically formed.

22. The sport helmet of claim 21, wherein the lattice is optically formed by collimated light beams.

23. The sport helmet of claim 21, wherein the lattice is optically formed by ultraviolet light.

24. The sport helmet of claim 1, wherein the nodes of the lattice are disposed in at least three levels that are spaced apart from one another in the thickness-wise direction of the sport helmet from the first surface of the sport helmet to the second surface of the sport helmet.

25. The sport helmet of claim 1, wherein the nodes of the lattice are disposed in at least four levels that are spaced apart from one another in the thickness-wise direction of the sport helmet from the first surface of the sport helmet to the second surface of the sport helmet.

26. The sport helmet of claim 1, wherein the nodes of the lattice are disposed in at least five levels that are spaced apart from one another in the thickness-wise direction of the sport helmet from the first surface of the sport helmet to the second surface of the sport helmet.

27. The sport helmet of claim 1, comprising an outer shell and a liner disposed within the outer shell, wherein: the first surface of the sport helmet is an exterior surface of the outer shell; and the second surface of the sport helmet is an interior surface of the liner.

28. The sport helmet of claim 1, wherein the structural members of the lattice extend in at least five different directions.

29. The sport helmet of claim 1, wherein the structural members of the lattice comprise struts.

30. The sport helmet of claim 1, wherein the lattice is configured to be compressed to half of a volume of the lattice and recover the volume of the lattice.

31. The sport helmet of claim 1, wherein the density of the lattice in a first region of the lattice located in a first area of the sport helmet differs from the density of the lattice in a second region of the lattice located in a second area of the sport helmet that is subject to greater impact force than the first area of the sport helmet during a sport.

32. The sport helmet of claim 1, wherein the regions of the lattice are distributed in a longitudinal direction of the lattice such that the density of the lattice varies in the longitudinal direction of the lattice.

33. The sport helmet of claim 1, wherein the flexible polymeric material comprises a polymeric resin and reinforcing fibers within the polymeric resin.

34. The sport helmet of claim 1, wherein each structural member has a constant cross-sectional dimension along its length.

35. The sport helmet of claim 1, wherein the designed dimensions, orientations and positions relative to one another of first ones of the structural members in a first region of the lattice located in a first area of the sport helmet differ from the designed dimensions, orientations and positions relative to one another of second ones of the structural members in a second region of the lattice located in a second area of the sport helmet that is subject to greater impact force than the first area of the sport helmet during a sport.

36. A sport helmet comprising:

an outer shell; and a liner disposed within the outer shell and comprising a lattice;

wherein: the lattice is formed of flexible polymeric material, is configured to deform from an initial shape upon an impact on the sport helmet and recover the initial shape thereafter to absorb at least part of the impact, and occupies at least a majority of a dimension from an exterior surface of the outer shell to an interior surface of the liner; the lattice comprises a regular geometrical arrangement of structural members that are formed of the flexible polymeric material, intersect one another at nodes, are integral and polymerized together at the nodes, and have designed dimensions, orientations and positions relative to one another individually controlled during formation of the structural members from the flexible polymeric material; and respective ones of the nodes of the lattice are spaced apart from one another in three orthogonal directions that include a thickness-wise direction of the sport helmet from the exterior surface of the outer shell to the interior surface of the liner.

37. A sport helmet comprising:

an outer shell; and a liner disposed within the outer shell and comprising a lattice;

wherein: the lattice is formed of flexible polymeric material and configured to deform from an initial shape upon an impact on the sport helmet and recover the initial shape thereafter to absorb at least part of the impact; the lattice comprises a regular geometrical arrangement of structural members that are formed of the flexible polymeric material, intersect one another at nodes, are integral and polymerized together at the nodes, and have designed dimensions, orientations and positions relative to one another individually controlled during formation of the structural members from the flexible polymeric material; respective ones of the nodes of the lattice are spaced apart from one another in three orthogonal directions that include a thickness-wise direction of the sport helmet from an exterior surface of the outer shell to an interior surface of the liner.

38. A sport helmet comprising:

an outer shell; and a liner disposed within the outer shell and comprising a lattice;

wherein: the lattice is formed of flexible polymeric material and is configured to deform from an initial shape upon an impact on the sport helmet and recover the initial shape thereafter to absorb at least part of the impact; the lattice comprises struts that are formed of the flexible polymeric material, intersect one another at nodes, are integral and polymerized together at the nodes, and have designed dimensions, orientations and positions relative to one another individually controlled during formation of the struts from the flexible polymeric material; respective ones of the nodes of the lattice are spaced apart from one another in three orthogonal directions that include a thickness-wise direction of the sport helmet from an exterior surface of the outer shell to an interior surface of the liner.

39. A method of manufacturing a liner for a sport helmet, the method comprises forming a lattice of the liner, the lattice comprising a regular geometrical arrangement of structural members that are formed of flexible polymeric material, intersect one another at nodes, and are integral and are polymerized together at the nodes, wherein said forming comprises individually controlling designed dimensions, orientations and positions of structural members relative to one another during formation of the structural members from the flexible polymeric material.

* * * * *